US008892017B2

(12) United States Patent
Tokuhiro et al.

(10) Patent No.: US 8,892,017 B2
(45) Date of Patent: Nov. 18, 2014

(54) FIXING DEVICE AND IMAGE FORMING APPARATUS

(75) Inventors: Eiichiro Tokuhiro, Kanagawa (JP); Kiyoshi Iwai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 246 days.

(21) Appl. No.: 13/480,913

(22) Filed: May 25, 2012

(65) Prior Publication Data

US 2013/0164055 A1 Jun. 27, 2013

(30) Foreign Application Priority Data

Dec. 21, 2011 (JP) ..... 2011-280324

(51) Int. Cl.
*G03G 15/20* (2006.01)

(52) U.S. Cl.
CPC ..... *G03G 15/2053* (2013.01); *G03G 15/2046* (2013.01)
USPC ..... 399/329

(58) Field of Classification Search
CPC ..... G03G 15/2039; G03G 15/2042; G03G 15/2046; G03G 15/2053
USPC ..... 399/328, 329, 333
See application file for complete search history.

(56) References Cited

U.S. PATENT DOCUMENTS

2009/0290917 A1* 11/2009 Baba et al. ..... 399/329
2010/0215390 A1* 8/2010 Tomita et al. ..... 399/69

FOREIGN PATENT DOCUMENTS

AU 2009201954 A1 12/2009
JP 2010-003673 A 1/2010

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

A fixing device includes a magnetic-field generating unit that generates a magnetic field; a substantially cylindrical fixing rotational body that faces the magnetic-field generating unit, generates heat by electromagnetic induction of the magnetic field, and melts and fixes a developer image to a recording medium; a temperature-sensitive contact part that contacts an inner side of the fixing rotational body, and faces the magnetic-field generating unit, its permeability decreasing if its temperature becomes a permeability-change start temperature or higher; and a temperature-sensitive non-contact part arranged at the inner side of the fixing rotational body to face the magnetic-field generating unit in a range different from the contact part, and spaced from the fixing rotational body. An angle defined by the contact part and the center of the fixing rotational body is 60° or larger.

5 Claims, 13 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2011-280324 filed Dec. 21, 2011.

BACKGROUND

The present invention relates to a fixing device and an image forming apparatus.

SUMMARY

According to an aspect of the invention, there is provided a fixing device including a magnetic-field generating unit that generates a magnetic field; a substantially cylindrical fixing rotational body that is arranged to face the magnetic-field generating unit, generates heat by electromagnetic induction of the magnetic field, melts a developer image, and fixes the developer image to a recording medium; a temperature-sensitive contact part that contacts an inner side of the fixing rotational body, and is arranged to face the magnetic-field generating unit, a permeability of the temperature-sensitive contact part decreasing if a temperature of the temperature-sensitive contact part becomes a permeability-change start temperature or higher; and a temperature-sensitive non-contact part that is arranged at the inner side of the fixing rotational body to face the magnetic-field generating unit in a range different from a range of the temperature-sensitive contact part, and is spaced from the fixing rotational body, a permeability of the temperature-sensitive non-contact part decreasing if a temperature of the temperature-sensitive non-contact part becomes a permeability-change start temperature or higher. An angle defined by the temperature-sensitive contact part and the center of the fixing rotational body is 60° or larger.

BRIEF DESCRIPTION OF THE DRAWINGS

Exemplary embodiments of the present invention will be described in detail based on the following figures, wherein.

DETAILED DESCRIPTION

First Exemplary Embodiment

Examples of a fixing device and an image forming apparatus according to a first exemplary embodiment are described.

General Configuration

Figure 1:
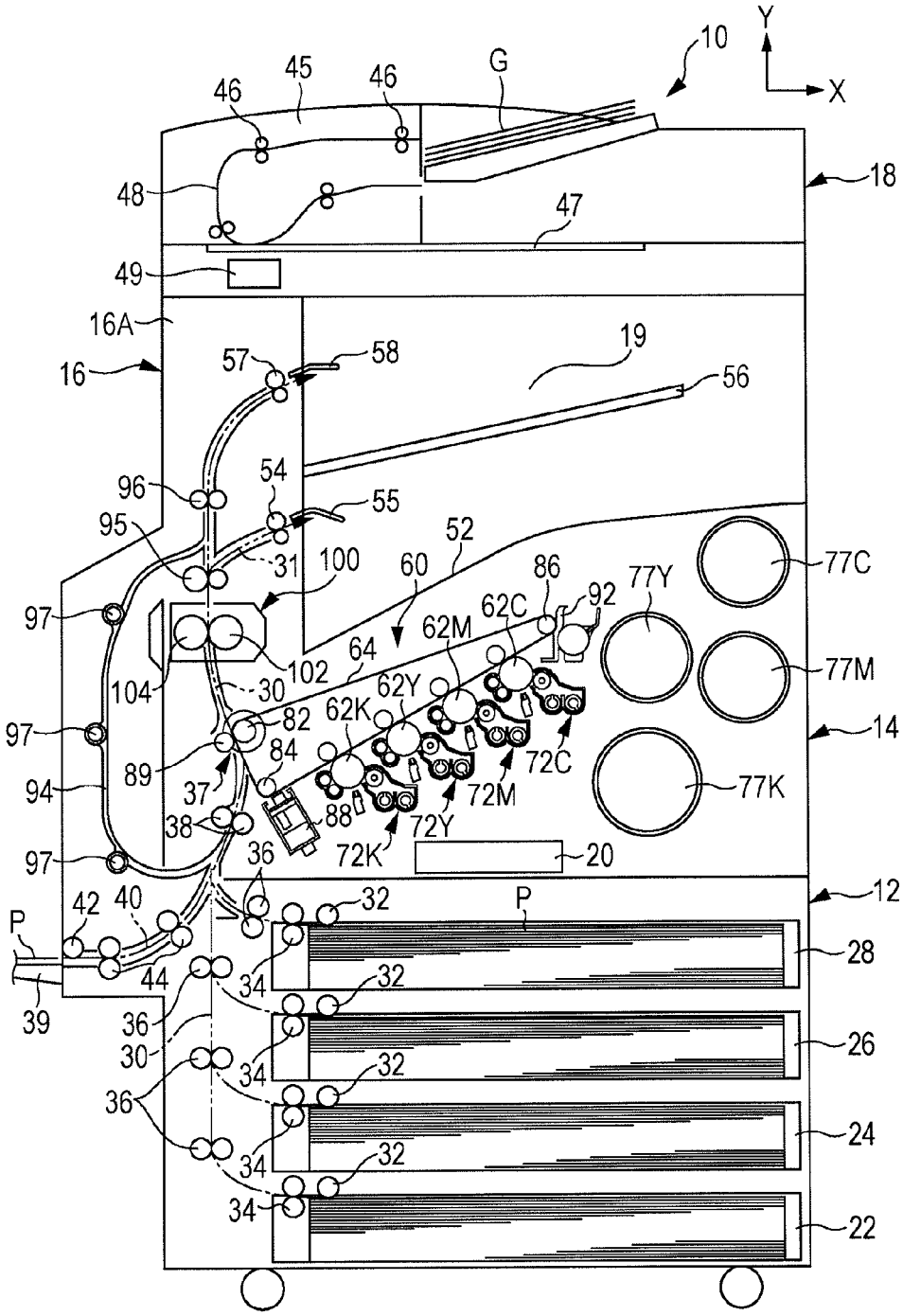
FIG. 1 is an overview of an image forming apparatus according to a first exemplary embodiment of the present invention.

FIG. 1 illustrates an image forming apparatus 10 as an example of a first exemplary embodiment. The image forming apparatus 10 includes a paper housing section 12 that houses recording paper P as an example of a recording medium, and an image forming section 14 that is provided above the paper housing section 12 and performs image formation on the recording paper P fed from the paper housing section 12, in order from the lower side to the upper side in the vertical direction (a direction indicated by arrow Y in the figure). Further, the image forming apparatus 10 includes an output section 16 that is integrally provided with an upper left portion of the image forming section 14 and outputs the recording paper P with an image formed thereon, a document reading section 18 that is provided above the output section 16 and reads a reading document G, and a control unit 20 that is provided in the image forming section 14 and serves as a controller that controls operations of respective sections of the image forming apparatus 10. In the following description, the vertical direction of the image forming apparatus 10 is mentioned as a Y direction, and the horizontal direction of the image forming apparatus 10 is mentioned as an X direction. Also, when the left and right are mentioned, the left and right are directions when the image forming apparatus 10 is viewed from the front side.

The paper housing section 12 includes a first housing part 22, a second housing part 24, a third housing part 26, and a fourth housing part 28 that are arranged in the Y direction and respectively house recording paper P of different sizes. The first housing part 22, the second housing part 24, the third housing part 26, and the fourth housing part 28 each are provided with a sending roller 32 that sends the housed recording paper P to a transport path 30 provided in the image forming apparatus 10, and a pair of transport rollers 34 and a pair of transport rollers 36 that are located downstream of the sending roller 32 in the transport path 30 and transport the recording paper P one by one. Also, registration rollers 38 are provided in the image forming section 14 and located downstream of the transport rollers 36 in a transport direction of the recording paper P in the transport path 30. The registration rollers 38 temporarily stop the recording paper P and sends the recording paper P to a second transfer part (the detail is described later) at a predetermined timing.

The image forming section 14 has a housing 16A that serves as an apparatus body. An upper left portion of the housing 16A at the upper left side of the image forming section 14 in front view of the image forming apparatus 10 protrudes as compared with an upper center portion and an upper right portion. A left end portion of the document reading section 18 is coupled with an upper end of the output section 16. Accordingly, an output area 19 that is surrounded by an upper surface of the image forming section 14, a lower surface of the document reading section 18, and a right surface of the output section 16 is formed in the image forming apparatus 10. The recording paper P is output from the output section 16 and is stacked in the output area 19.

An auxiliary transport path 40 is provided at a side opposite to the transport rollers 36 of the fourth housing part 28 with respect to the transport path 30. Recording paper P is transported from a foldable manual paper feed part 39 that is provided at a left surface of the image forming apparatus 10 in front view of the image forming apparatus 10, to the transport path 30. A sending roller 42 that sends the recording paper P on the manual paper feed part 39 to the auxiliary transport path 40, and plural transport rollers 44 that are provided downstream of the sending roller 42 and transport the recording paper P one by one are provided in the auxiliary transport path 40. A downstream end of the auxiliary transport path 40 is connected with the transport path 30.

Also, a fixing device 100 (the detail is described later) is provided downstream of the second transfer part 37 in the transport path 30 in the image forming section 14. The fixing device 100 includes a fixing belt 102 that heats a developer (toner) on recording paper P, and a pressure roller 104 that presses the recording paper P toward the fixing belt 102. When the recording paper P passes through a nip part N (see FIG. 3A) that is a contact part between the fixing belt 102 and the pressure roller 104, the toner is molten and solidified, and hence a toner image is fixed to the recording paper P.

Figure 2:
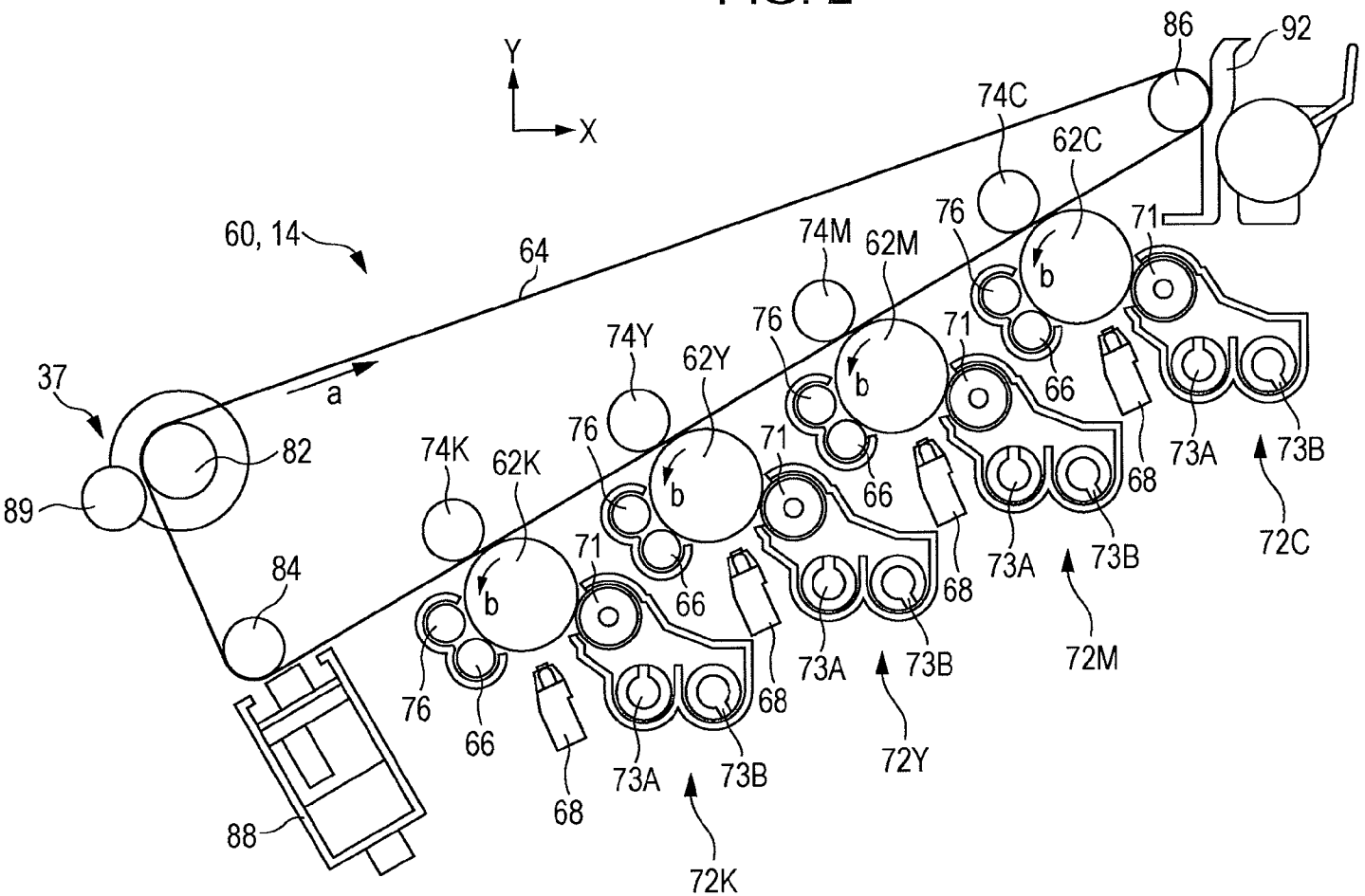
FIG. 2 is a configuration diagram of an image forming unit according to the first exemplary embodiment of the present invention.

As shown in FIGS. 1 and 2, an image forming unit 60 is provided at the center of the image forming section 14. The image forming unit 60 serves as an example of a developer image forming unit that forms a toner image (a developer image) on recording paper P by combining toners of respective colors including black (K), yellow (Y), magenta (M), and cyan (C). The image forming unit 60 includes photoconductors 62K, 62Y, 62M, and 62C that serve as latent image holding bodies for holding latent images, and correspond to the toners of the respective colors including black (K), yellow (Y), magenta (M), and cyan (C). In the following description, if K, Y, M, and C have to be distinguished from each other, a component is described with either of characters K, Y, M, and C following a reference number; however, if components have similar configurations and K, Y, M, and C do not have to be distinguished from each other, the character K, Y, M, or C is omitted.

As shown in FIG. 2, the photoconductors 62K, 62Y, 62M, and 62C are arranged toward an obliquely upper right side of the figure in that order, rotate in a direction indicated by arrow b (in the figure, the counterclockwise direction), and hold electrostatic latent images formed by light irradiation on outer peripheral surfaces. Also, a charging roller 66, a light emitting diode (LED) head 68, a developing device 72, an intermediate transfer belt 64 (a first transfer roller 74), and a cleaning roller 76 are provided around each of the photoconductors 62K, 62Y, 62M, and 62C in that order in the direction indicated by arrow b.

The charging roller 66 has an example configuration in which plural layers (not shown) including a conductive elastic layer, an intermediate layer, and a surface resin layer are formed around a shaft part made of stainless steel. Also, the shaft part of the charging roller 66 is rotatable so that an outer peripheral surface of the charging roller 66 contacts a surface layer of the photoconductor 62 and the charging roller 66 is driven by the photoconductor 62. A voltage applying unit (not shown) applies a voltage to the charging roller 66 and hence an electric discharge occurs. The electric discharge electrically charges the outer peripheral surface of the photoconductor 62.

The LED head 68 irradiates (exposes) the outer peripheral surface of the photoconductor 62 that is electrically charged by the charging roller 66, with light (to light) corresponding to a color of each toner, and hence an electrostatic latent image is formed. It is to be noted that a system using laser light common to the four colors of K, Y, M, and C and scanning with a polygonal mirror may be used as an exposure device for the photoconductor 62.

The developing device 72 includes a development roller 71 that feeds a developer to a latent image formed on the photoconductor 62 and forms a developer image (a toner image), and transport members 73A and 73B that transport the developer to the development roller 71 in a circulating manner. It is to be noted that the developer may be any of a two-component developer containing a toner and a carrier and a one-component developer containing a toner.

The intermediate transfer belt 64 has an endless form, and is wound around a belt transport roller 82 provided at the second transfer part 37, a belt transport roller 84 provided at a lower right side of the belt transport roller 82, and a driving roller 86 that is provided at an obliquely upper right side of the belt transport roller 82 and that is driven by a motor (not shown), rotatably in a direction indicated by arrow a (in the figure, the clockwise direction). An outer peripheral surface of the intermediate transfer belt 64 serves as a transfer surface on which a toner image is transferred. The outer peripheral surfaces of the photoconductors 62K, 62Y, 62M, and 62C are in contact with the transfer surface of the intermediate transfer belt 64 in an area from the driving roller 86 to the belt transport roller 84.

The first transfer rollers 74 (74K, 74Y, 74M, 74C) are provided at a side opposite to the photoconductors 62K, 62Y, 62M, and 62C with respect to the intermediate transfer belt 64. Each first transfer roller 74 is in contact with an inner peripheral surface of the intermediate transfer belt 64. A voltage applying unit (not shown) applies a voltage to the first transfer roller 74, a potential difference is generated between the first transfer roller 74 and the photoconductor 62 that is grounded, and hence a toner image on the photoconductor 62 is first-transferred on the transfer surface of the intermediate transfer belt 64. Accordingly, respective toner images are transferred on the intermediate transfer belt 64 in a superposed manner while the intermediate transfer belt 64 moves by one turn.

A toner density sensor 88 is provided at a side opposite to the belt transport roller 84 with respect to the intermediate transfer belt 64. The toner density sensor 88 has a function of detecting the density of a toner image transferred on the transfer surface of the intermediate transfer belt 64. Further, a cleaning member 92 is provided at a side opposite to the driving roller 86 with respect to the intermediate transfer belt 64. The cleaning member 92 cleans a toner etc. remaining on the transfer surface of the intermediate transfer belt 64 after the second transfer.

The second transfer part 37 includes the belt transport roller 82, on which the intermediate transfer belt 64 is wound, and a second transfer roller 89 provided at a side opposite to the belt transport roller 82 with respect to the intermediate transfer belt 64. A voltage applying unit (not shown) applies a voltage to the belt transport roller 82 or the second transfer roller 89, a potential difference is generated between the belt transport roller 82 and the second transfer roller 89, and hence a toner image on the intermediate transfer belt 64 is second-transferred on recording paper P.

As shown in FIG. 1, toner cartridges 77K, 77Y, 77M, 77C that house the respective toners of black (K), yellow (Y), magenta (M), and cyan (C) are exchangeably provided at the right side of the cleaning member 92 of the image forming section 14. Also, a duplex transport path 94 is provided at the left side of the transport path 30 in the image forming section 14. When image formation is performed on both sides of recording paper P, the recording paper P is transported and reversed in the duplex transport path 94.

One end of the duplex transport path 94 is connected with the transport path 30 at a position between transport rollers 95 provided downstream of the fixing device 100 in the transport direction of recording paper P and transport rollers 96 which are provided downstream of the transport rollers 95 and the rotation direction of which is changeable. The other end of the duplex transport path 94 is connected with the transport path 30 at a position located upstream of the registration rollers 38. Also, plural transport rollers 97 are provided in the duplex transport path 94. The transport rollers 97 transport recording paper P sent by the transport rollers 96 toward the registration rollers 38. Accordingly, when duplex image formation is performed, recording paper P with a toner image fixed to a front surface of the recording paper P by the fixing device 100 enters the duplex transport path 94 by reverse rotation of the transport rollers 96 and a path changing member (not shown), and the recording paper P enters the registration rollers 38 again. Thus, the front and back of the recording paper P is reversed.

Also, lower output rollers 54 are provided in a transport path 31 that is located downstream of the transport rollers 95 in the output section 16 and branches toward the output area 19 from the transport path 30. The lower output rollers 54 output recording paper P to a lower tray 52 provided on the image forming section 14. A lower detector 55 is provided at a position next to the lower output rollers 54. The lower detector 55 detects the stack height of recording paper P stacked on the lower tray 52. Also, upper output rollers 57 are provided in part of the transport path 30, the part which is located downstream of the transport rollers 95 in the output section 16. The upper output rollers 57 output recording paper P to an upper tray 56 that is provided above the lower tray 52. An upper detector 58 is provided at a position next to the upper output rollers 57. The upper detector 58 detects the stack height of recording paper P stacked on the upper tray 56.

The document reading section 18 includes a document transport device 45 that automatically transports reading documents G one by one; a platen glass 47 that is arranged below the document transport device 45, a single reading document G being placed on the platen glass 47; and a document reading device 49 that reads the reading document G transported by the document transport device 45 or the reading document G placed on the platen glass 47. The document transport device 45 includes an automatic transport path 48 in which plural pairs of transport rollers 46 are arranged. Part of the automatic transport path 48 is arranged such that recording paper P passes through a position on the platen glass 47. The document reading device 49 reads the reading document G transported by the document transport device 45 while stopped at a left end portion of the platen glass 47, or reads the reading document G placed on the platen glass 47 while moving in the X direction.

Next, an image formation process by the image forming apparatus 10 is described.

As shown in FIG. 1, when the image forming apparatus 10 is activated, image data of the respective colors including black (K), yellow (Y), magenta (M), and cyan (C) is output from an image processing device (not shown) or an external device to the LED heads 68 (see FIG. 2). Then, light emitted from the LED heads 68 in accordance with the image data exposes with light the outer peripheral surfaces (surfaces) of the photoconductors 62 electrically charged by the charging rollers 66. Hence, electrostatic latent images are respectively formed on the surfaces of the photoconductors 62 in accordance with the image data of the respective colors. Further, the electrostatic latent images respectively formed on the surfaces of the photoconductors 62 are respectively developed as toner images by the developing devices 72. The toner images on the surfaces of the photoconductors 62 are successively transferred by the first transfer rollers 74 on the intermediate transfer belt 64 in a superposed manner.

Meanwhile, recording paper P sent from the paper housing section 12 and transported through the transport path 30 is transported to the second transfer part 37 at a timing at which the transfer of the superposed toner image on the intermediate transfer belt 64, the timing which is adjusted by the registration rollers 38. The superposed toner image transferred on the intermediate transfer belt 64 is second-transferred by the second transfer roller 89 on the recording paper P transported to the second transfer part 37.

Then, the recording paper P with the toner image transferred thereon is transported to the fixing device 100. The fixing device 100 fixes the toner image to the recording paper P by heating and pressing the recording paper P with the fixing belt 102 and the pressure roller 104. Further, the recording paper P with the toner image fixed thereon is output from the output section 16 to the lower tray 52 or the upper tray 56. When images are formed on both sides of recording paper P, an image is fixed to a front surface of recording paper P by the fixing device 100, then a lower end of the recording paper P is sent from the transport rollers 96 to the duplex transport path 94, and the lower end is sent to the registration rollers 38 (the transport path 30), thereby switching the leading end of the recording paper P with the trailing end. Then, image formation and fixing are performed on a back surface of the recording paper P.

Feature Configuration

Next, the fixing device 100 is described.

Figure 3A:
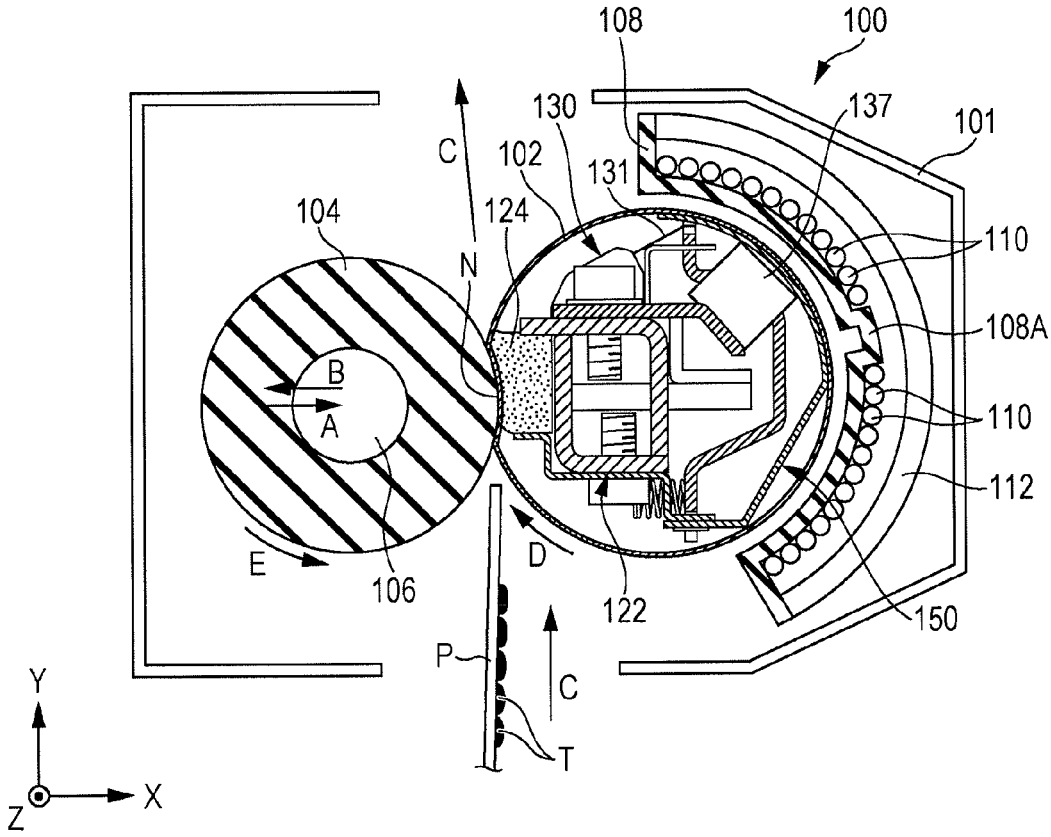
FIG. 3A is a configuration diagram of a fixing device according to the first exemplary embodiment of the present invention.

As shown in FIG. 3A, the fixing device 100 includes a housing 101 having an opening through which recording paper P enters the fixing device 100 or is output from the fixing device 100. The fixing belt 102 that is endless and serves as an example of a fixing rotational body that rotates in a direction indicated by arrow D is provided in the housing 101.

Circular cap members 138 and 139 (see FIG. 5) are mounted to both ends of the fixing belt 102 in the axial direction (a z direction). The fixing belt 102 is rotatable because the cap members 138 and 139 are rotatably supported by a bearing (not shown) provided at the housing 101.

The fixing belt 102 is connected with a drive source (not shown) including a motor, and is rotated by the drive source when the pressure roller 104 (described later) is separated from the fixing belt 102 by a retract mechanism (not shown). When the temperature of the fixing belt 102 becomes a predetermined temperature, the pressure roller 104 moves and comes into contact with the fixing belt 102.

Figure 3B:
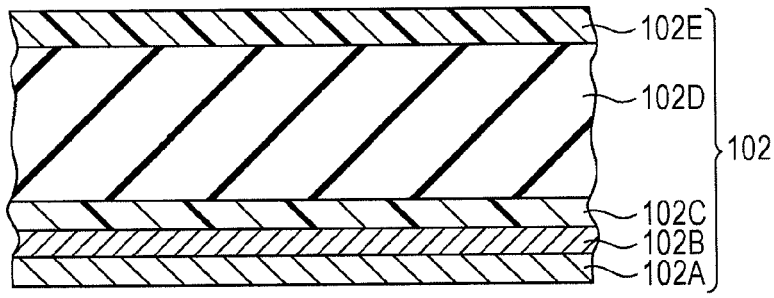
FIG. 3B is a cross-sectional view of a fixing belt according to the first exemplary embodiment of the present invention.

Also, as shown in FIG. 3B, the fixing belt 102 has a configuration in which a base layer 102A, a heat-generating layer 102B, a protection layer 102C, an elastic layer 102D, and a release layer 102E are layered and integrated in that order toward the outside in the radial direction.

The base layer 102A serves as a base that retains the strength of the fixing belt 102, and is formed of, for example, polyimide (PI). For another example, the base layer 102A may use non-magnetic stainless steel.

Figure 11A:
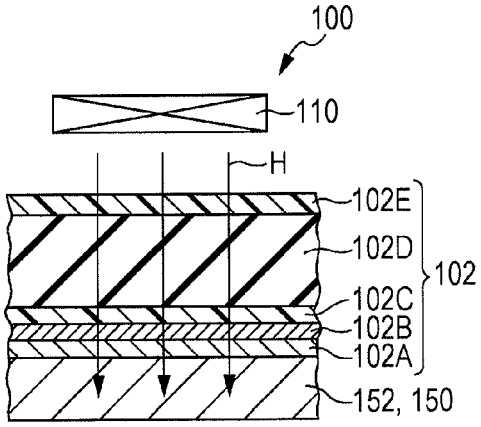
FIGS. 11A and 11B are schematic illustrations respectively showing a state in which a magnetic field acts on the temperature-sensitive magnetic member and a state in which a magnetic field penetrates through the temperature-sensitive magnetic member at a temperature-sensitive contact part according to the first exemplary embodiment of the present invention.

The heat-generating layer 102B uses a metal material that generates heat by an electromagnetic induction effect in which eddy current flows to generate a magnetic field for canceling a magnetic field H (see FIG. 11A). The metal material is, for example, copper. Also, the heat-generating layer 102B has to be formed thinner than a skin depth as a thickness by which the magnetic field H is able to enter, to allow the magnetic flux of the magnetic field H to penetrate through the heat-generating layer 102B. When δ is a skin depth, $\rho_n$ is a specific resistance and $\mu_n$ is a relative permeability of the heat-generating layer 102B, and f is a frequency of a signal (current) in an exciting coil 110, δ is expressed by Expression (1) as follows:

$$\delta_n = 503\sqrt{\frac{\rho_n}{f \cdot \mu_n}}. \quad (1)$$

The protection layer 102C is formed of synthetic resin, and is formed of, for example, polyimide like the base layer 102A.

The elastic layer 102D uses silicon rubber or fluorocarbon rubber because the material is elastic and heat-resistant. In this exemplary embodiment, for example, the elastic layer 102D uses silicon rubber. Also, the release layer 102E is provided to decrease a bonding force with respect to a toner image T molten on recording paper P and cause the recording paper P to be easily separated from the fixing belt 102. In this exemplary embodiment, for example, the release layer 102E is formed of tetra-fluoro-ethylene perfluoro-alkyl-vinyl-ether copolymer (PFA).

A bobbin 108 is arranged at a position to face an outer peripheral surface of the fixing belt 102. The bobbin 108 is formed of an insulating material. The bobbin 108 has an arc shape to extend along the outer peripheral surface of the fixing belt 102. The bobbin 108 has a protrusion 108A at a center portion in the circumferential direction of the bobbin 108, at a side opposite to the fixing belt 102. The exciting coil 110, as an example of a magnetic-field generating unit, is wound on the bobbin 108 plural times around the protrusion 108A in the axial direction (in the depth direction of FIG. 3A, hereinafter, referred to as a Z direction). It is to be noted that the formation position of the protrusion 108A shown in FIG. 3A is a mere example, and may be alternatively formed at a position to face the boundary (see a point B in FIG. 9) between a temperature-sensitive contact part 152 and a temperature-sensitive non-contact part 153 of a temperature-sensitive magnetic member 150 (described later).

Also, a magnetic core 112 is arranged at a side opposite to the bobbin 108 with respect to the exciting coil 110 and supported by the bobbin 108. The magnetic core 112 has an arc shape extending along the arc shape of the bobbin 108. The magnetic core 112 is made of a ferrite magnetic material.

Meanwhile, the pressure roller 104 is provided at a position to face the outer peripheral surface of the fixing belt 102, at a side opposite to the exciting coil 110. The pressure roller 104 presses the fixing belt 102 and recording paper P toward a support body 122 (described later) and is driven in a direction indicated by arrow E by rotation of the fixing belt 102. The recording paper P enters and is output in a direction indicated by arrow C by the rotation of the pressure roller 104 and the fixing belt 102.

For example, the pressure roller 104 has a core bar 106 made of aluminum, and the periphery of the core bar 106 is coated with silicon rubber and PFA. Also, the pressure roller 104 is movable in a direction indicated by arrow A (a direction toward the fixing belt 102) or a direction indicated by arrow B (a direction away from the fixing belt 102) by the retract mechanism (not shown). The pressure roller 104 moves in the direction indicated by arrow A, to come into contact with the outer peripheral surface of the fixing belt 102, and press the outer peripheral surface; or moves in the direction indicated by arrow B, to be separated from the outer peripheral surface of the fixing belt 102.

Next, the configuration at the inner side of the fixing belt 102 is described.

As shown in FIG. 3A, provided at the inner side of the fixing belt 102 are the temperature-sensitive magnetic member 150 (the detail is described later), the support body 122 that supports the temperature-sensitive magnetic member 150, a pushing member 124 that pushes the fixing belt 102 against the pressure roller 104, a thermistor 130 that detects the temperature of the fixing belt 102, and a thermostat 137 that restricts an excessive temperature rise of the fixing belt 102.

The support body 122 is formed by combining plural steel sheets having a longitudinal direction extending in the Z direction. Both ends in the Z direction penetrate through the cap members 138 and 139 (see FIG. 5) and fixed to the housing 101. The support body 122 supports the temperature-sensitive magnetic member 150 and the pushing member 124, and resists a pressure force from the pressure roller 104.

The pushing member 124 has one end surface in the X direction that is fixed to the support body 122 and the other surface that is in contact with part of an inner peripheral surface of the fixing belt 102, the part which is near the pressure roller 104. For example, the pushing member 124 is formed of a urethane rubber pad that is flexibly deformed by pressure of the pressure roller 104. The pushing member 124 and the pressure roller 104 pinch the fixing belt 102, and hence form the nip part N where the fixing belt 102 comes into contact with the pressure roller 104 along the circumferential direction.

Figure 5:
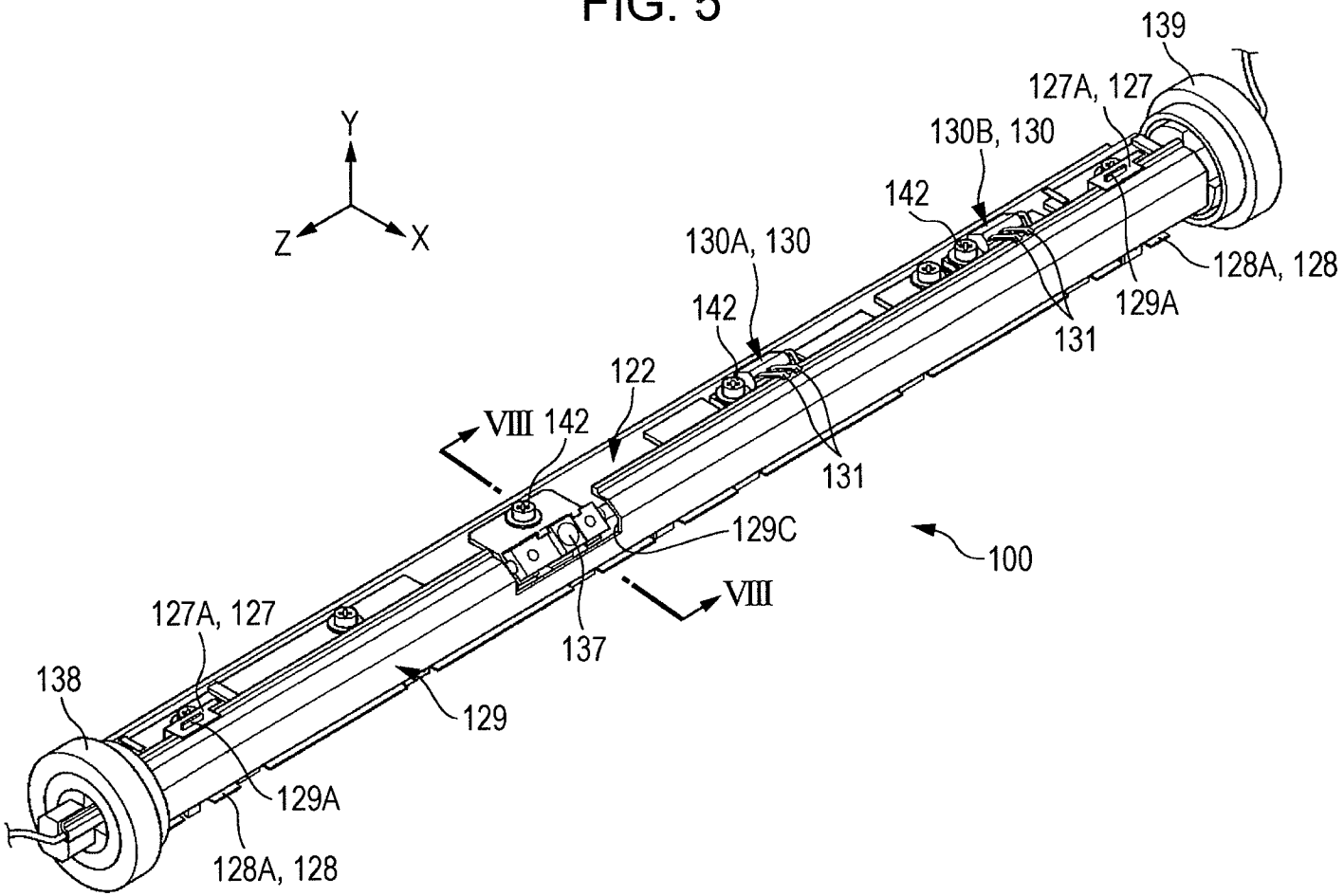
FIG. 5 is a perspective view showing a state in which a temperature-sensitive magnetic member is removed from a configuration at the inner side of the fixing belt according to the first exemplary embodiment of the present invention.
Figure 7:
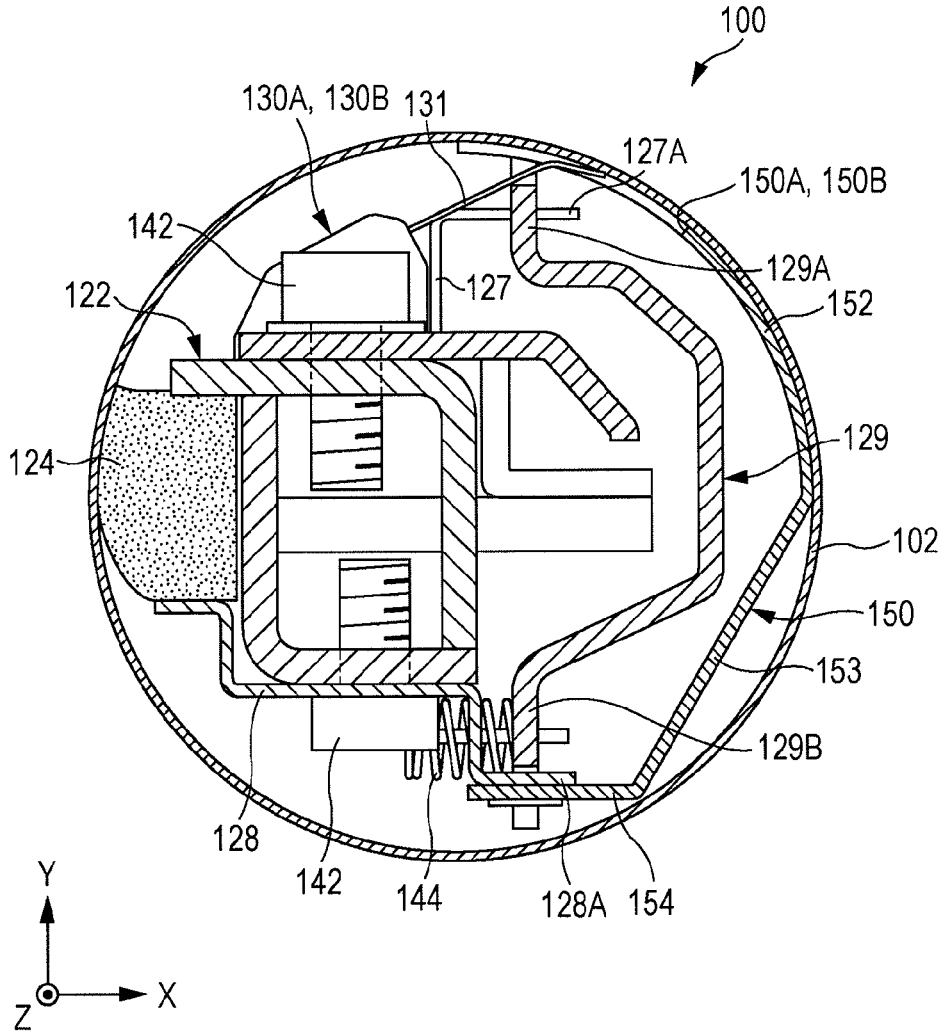
FIG. 7 is a cross-sectional view (a section taken along line VII-VII in FIG. 6) showing the configuration at the inner side of the fixing belt according to the first exemplary embodiment of the present invention.
Figure 8:
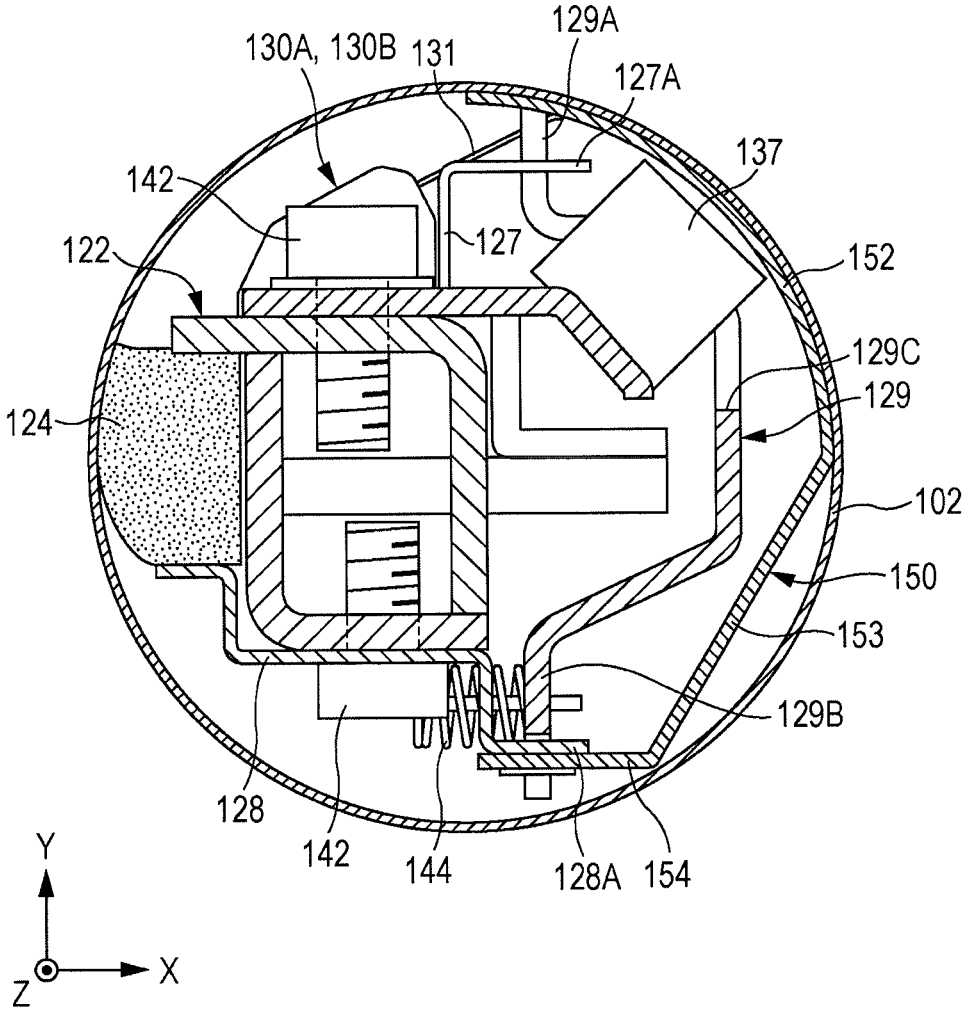
FIG. 8 is a cross-sectional view (a section taken along line VIII-VIII in FIG. 5) showing the configuration at the inner side of the fixing belt according to the first exemplary embodiment of the present invention.

As shown in FIGS. 5, 7, and 8, plural leaf springs 127 and 128 are mounted to end portions in the Y direction (at upper and lower ends in the figures) at both end portions in the Z direction of the support body 122. The leaf springs 127 and 128 have extending portions 127A and 127B that are crank-shaped free ends bent two times and extend in a direction (the X direction) toward and away from the inner peripheral surface of the fixing belt 102 (see FIG. 3A). The extending portions 127A and 128A are coupled by a coupling member 129.

The coupling member 129 is formed by bending a metal sheet and has a longitudinal direction extending in the Z direction. In this exemplary embodiment, for example, the coupling member 129 uses aluminum that is a non-magnetic material. Accordingly, if a magnetic field H (described later) leaks to the inside with respect to the temperature-sensitive magnetic member 150 (see FIG. 3A), the magnetic field H is prevented from acting on the support body 122.

Also, the coupling member 129 has protruding portions 129A and 129B (see FIG. 7) located at positions at which the extending portions 127A and 128A of the leaf springs 127 and 128 are superposed on the temperature-sensitive magnetic member 150 (see FIG. 3A) in the Y direction, and protruding toward both sides in the Y direction. Here, the protruding portions 129A and 129B are inserted into through holes (not shown) formed at the leaf springs 127 and 128 and through holes (not shown) formed at the temperature-sensitive magnetic member 150, so that the coupling member 129 couples these members and the coupling member 129 itself is supported by the leaf springs 127 and 128. The coupling member 129 is not in contact with the support body 122 in the X direction.

The thermistor 130 and the thermostat 137 are mounted to the support body 122 by screws 142. The thermistor 130 includes a thermistor 130A arranged at a center portion in the Z direction of the support body 122, and a thermistor 130B arranged at an end portion (one end) in the Z direction. Also, the thermostat 137 is arranged at a center portion in the Z direction of the support body 122. A rectangular notch 129C is formed at part of the coupling member 129 to cause the thermostat 137 to be exposed.

Figure 6:
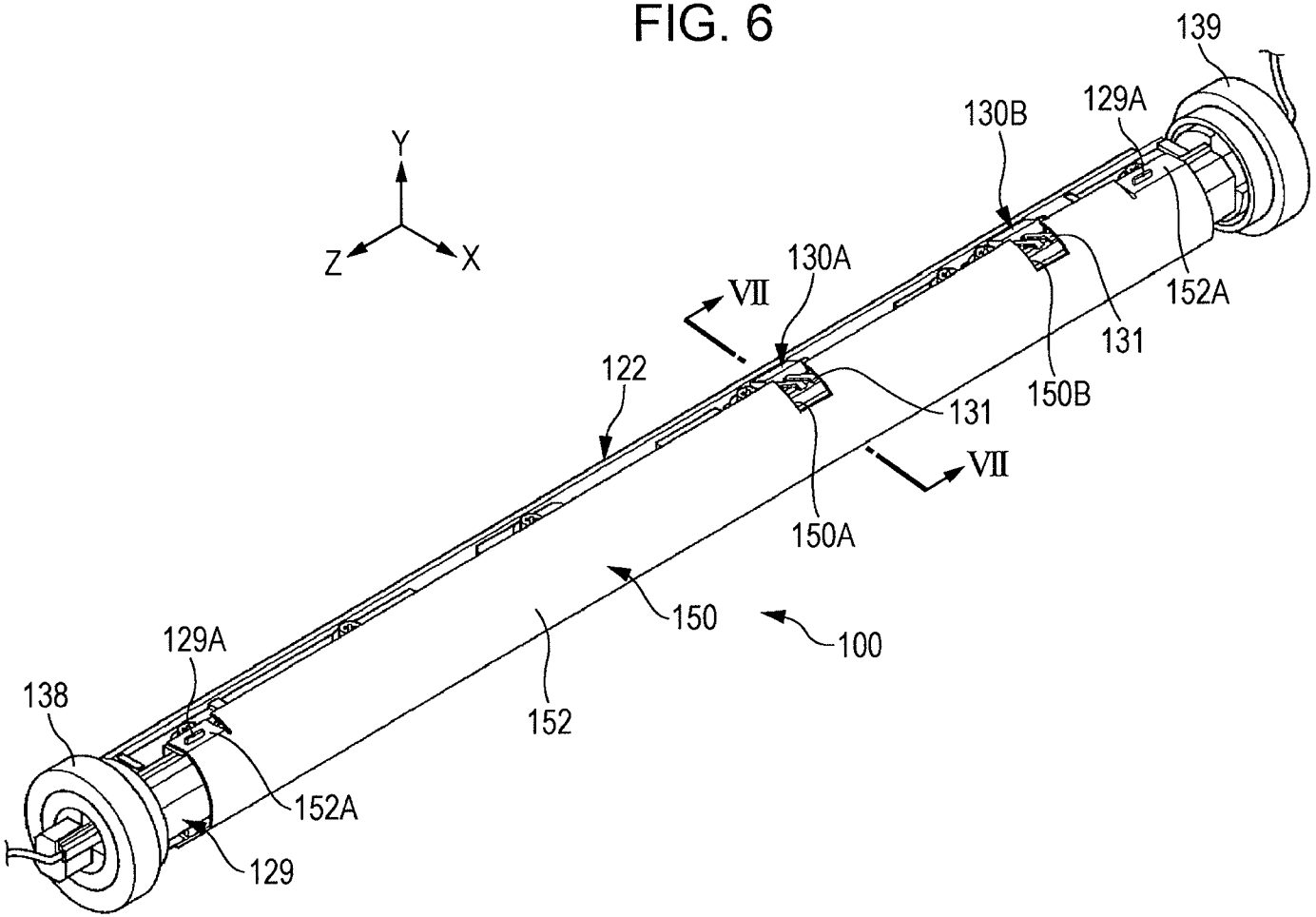
FIG. 6 is a perspective view showing a state in which the temperature-sensitive magnetic member is mounted to the configuration at the inner side of the fixing belt according to the first exemplary embodiment of the present invention.

FIG. 6 illustrates a state in which the temperature-sensitive magnetic member 150 is mounted to the leaf springs 127 and 128 shown in FIG. 5. The temperature-sensitive magnetic member 150 has rectangular notches 150A and 150B formed at the center portion and the end portion (one end) in the Z direction. The notches 150A and 150B are formed at positions corresponding to the installation positions of the thermistors 130A and 130B. Contact parts 131 are exposed through the notches 150A and 150B.

As shown in FIG. 7, the contact parts 131 of the thermistors 130A and 130B are in contact with the inner peripheral surface of the fixing belt 102 through the notches 150A and 150B of the temperature-sensitive magnetic member 150. Accordingly, the temperature of the fixing belt 102 is directly detectable. Also, one end of a spring 144, serving as an example of an urging portion, is fixed to a lower portion of the support body 122. The other end of the spring 144 urges the protruding portion 129B of the coupling member 129 in the X direction. Accordingly, the extending portions 127A and 128A of the leaf springs 127 and 128 are bent toward the fixing belt 102, and the temperature-sensitive magnetic member 150 is urged toward the fixing belt 102.

As shown in FIG. 8, the thermostat 137 has a detecting portion that passes through the notch 129C of the coupling member 129 and is arranged at a position near a back surface of the temperature-sensitive contact part 152 (described later) of the temperature-sensitive magnetic member 150. As described above, since the thermostat 137 detects the temperature of the fixing belt 102 indirectly through the temperature-sensitive magnetic member 150, a correspondence table of the temperature of the fixing belt 102 and the temperature of the temperature-sensitive magnetic member 150 is previously set. The detected temperature of the temperature-sensitive magnetic member 150 is converted into the temperature of the fixing belt 102 with reference to this correspondence table.

Next, the temperature detection of the fixing belt 102 is described.

As shown in FIG. 3A, the thermistor 130 that detects the temperature of the fixing belt 102 is provided at the inner side of the fixing belt 102. The thermistor 130 has the contact part 131 that contacts the inner peripheral surface of the fixing belt 102. The resistance value of the contact part 131 is changed in accordance with the amount of heat applied from the inner peripheral surface of the fixing belt 102. Hence, the temperature of the fixing belt 102 is measured. Also, the number of mount positions in the Z direction of the thermistors 130 is two. The two positions are the center portion and the end portion in the axial direction (the Z direction) of the fixing belt 102 so as to measure the temperature of part of the fixing belt 102 not facing paper.

Figure 4:
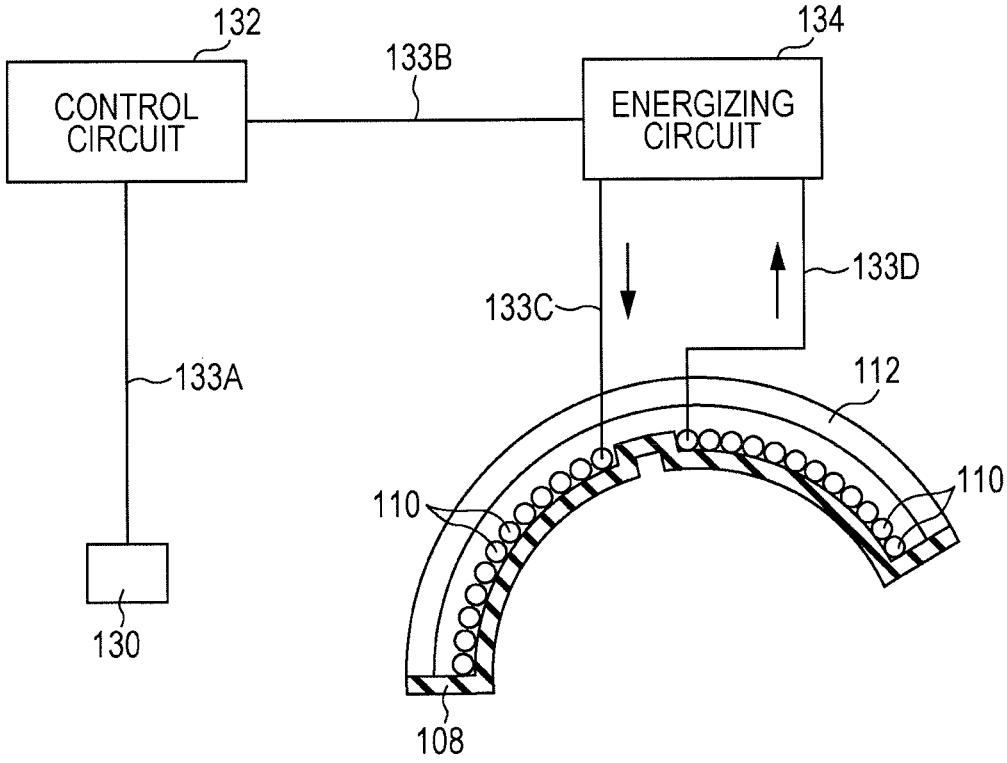
FIG. 4 is a schematic illustration showing a connection state of a thermistor, a control circuit, an energizing circuit, and an exciting coil according to the first exemplary embodiment of the present invention.

As shown in FIG. 4, the thermistor 130 is connected with a control circuit 132 that is provided in the control unit 20 (see FIG. 1) through a wire 133A. The control circuit 132 is connected with an energizing circuit 134 through a wire 133B. The energizing circuit 134 is connected with the exciting coil 110 through wires 133C and 133D.

The control circuit 132 detects (measures) the temperature of the inner peripheral surface of the fixing belt 102 based on the amount of electricity sent from the thermistor 130, and compares the detection temperature and a previously stored heat setting temperature. If the detection temperature is lower than the heat setting temperature, the energizing circuit 134 is driven to energize the exciting coil 110, so that the magnetic field H (see FIG. 11A) serving as a magnetic circuit is generated. In contrast, if the detection temperature is higher than the heat setting temperature, energization by the energizing circuit 134 is stopped. The heat setting temperature may be any setting value of a median value, a lower limit value, and an upper limit value of target temperatures.

In the fixing device 100, when the energizing circuit 134 is driven in response to an electric signal from the control circuit 132 and alternating current is supplied to the exciting coil 110, generation and non-generation of the magnetic field H (see FIG. 11A) as the magnetic circuit are repeated around the exciting coil 110. When the magnetic field H passes across the heat-generating layer 102B (see FIG. 11A) of the fixing belt 102, eddy current (not shown) is generated at the heat-generating layer 102B so as to generate a magnetic field that disturbs a change in magnetic field H. Accordingly, the heat-generating layer 102B generates heat in proportion to the magnitude of eddy current flowing through the heat-generating layer 102B. Thus, the fixing belt 102 is heated by the electromagnetic induction effect.

Next, the detail of the temperature-sensitive magnetic member 150 is described.

Figure 9:
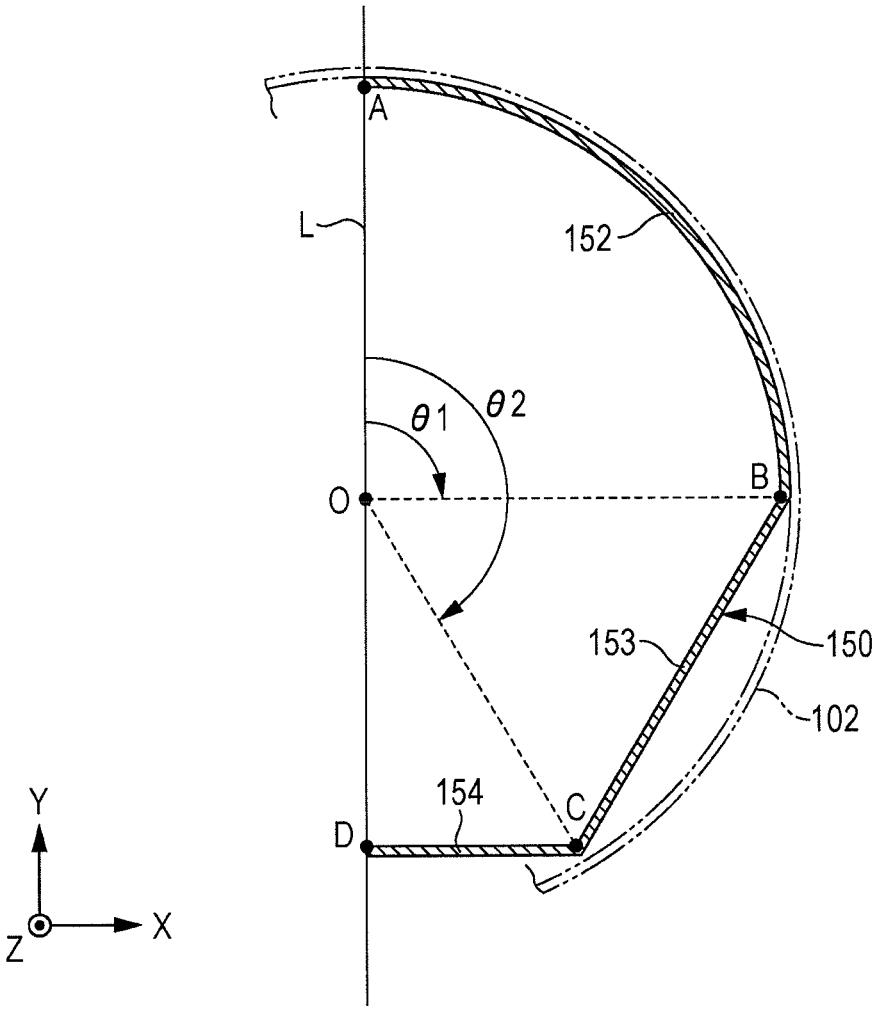
FIG. 9 is a cross-sectional view of the temperature-sensitive magnetic member according to the first exemplary embodiment of the present invention.

The temperature-sensitive magnetic member 150 shown in FIG. 9 is formed of a temperature-sensitive magnetic material having a characteristic in which its permeability starts continuously decreasing if its temperature becomes a permeability-change start temperature or higher in a temperature range that is the heat setting temperature of the fixing belt 102 or higher and the heat-resistance temperature of the fixing belt 102 or lower. Specifically, magnetic shunt steel, an amorphous alloy, etc., is used. A metal alloy material of any of Fe, Ni, Si, B, Nb, Cu, Zr, Co, Cr, V, Mn, and Mo is used, and more particularly, for example, binary magnetic shunt steel such as a Fe—Ni alloy, or ternary magnetic shunt steel such as a Fe—Ni—Cr alloy may be used. In this exemplary embodiment, a Fe—Ni alloy is used.

Figure 10:
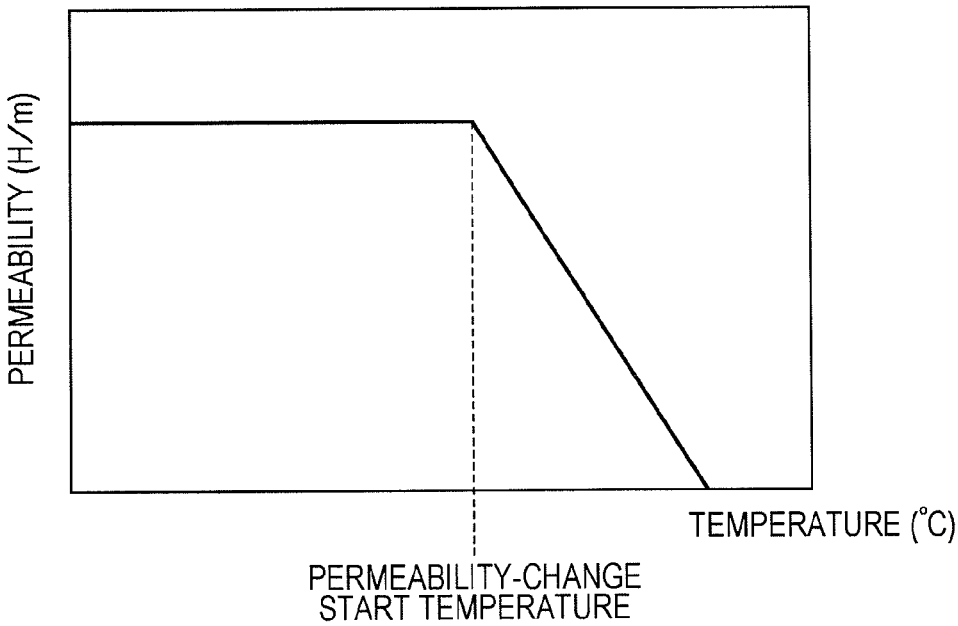
FIG. 10 is a schematic illustration showing the relationship between the temperature and the permeability of the temperature-sensitive magnetic member according to the first exemplary embodiment of the present invention.

As shown in FIG. 10, the permeability-change start temperature is a temperature at which a permeability (measured under JIS C2531) starts continuously decreasing, and at which a penetrating amount of a magnetic flux of a magnetic field starts changing. The permeability-change start temperature differs from a Curie point.

As shown in FIG. 9, when viewed in an X-Y section, the temperature-sensitive magnetic member 150 has a shape in which the arc-like (substantially ¼ circle-like) temperature-sensitive contact part 152, the linear temperature-sensitive non-contact part 153 extending from one end of the temperature-sensitive contact part 152 to the obliquely lower side, and a linear mount part 154 that extends in a direction opposite to the X direction from an end of the temperature-sensitive non-contact part 153 opposite to the temperature-sensitive contact part 152 are integrated. In FIG. 9, it is assumed that a line passing through a perfect circle reference center O of the fixing belt 102 and being parallel to the Y direction is a line L, an intersection point of the line L and one end of the temperature-sensitive contact part 152 is a point A, a boundary point of the temperature-sensitive contact part 152 and the temperature-sensitive non-contact part 153 is a point B, and a boundary point of the temperature-sensitive non-contact part 153 and the mount part 154 is a point C, and an end point of the mount part 154 opposite to the point C is a point D.

For example, the temperature-sensitive contact part 152 is formed in an arc-like shape with a central angle AOB (an angle θ1) of about 90°, and is entirely in contact with the inner side of the fixing belt 102 along the exciting coil 110 (see FIG. 3A) (in a range facing the exciting coil 110). An outer peripheral surface of the temperature-sensitive contact part 152 is treated with surface processing (for example, nitriding) for ensuring slidability of the fixing belt 102. The temperature-sensitive contact part 152 is also substantially entirely in contact with the inner side of the fixing belt 102 in the Z direction. Also, as shown in FIG. 6, flat portions 152A are formed at both ends in the Z direction of the temperature-sensitive contact part 152 and extend along the X direction. The flat portions 152A have through holes (not shown) penetrating through part of the flat portions 152A, and are mounted to the protruding portions 129A of the coupling member 129 together with the extending portions 127A (see FIG. 7) of the leaf springs 127.

For example, the point C of the temperature-sensitive non-contact part 153 is arranged so that an angle AOC (an angle θ2) with reference to a segment OA is about 150°. A range indicated by a segment BC is in a non-contact state with respect to the fixing belt 102. In other words, the temperature-sensitive non-contact part 153 is arranged to face the exciting coil 110 (see FIG. 3A) at the inner side of the fixing belt 102 and is spaced from the fixing belt 102. The width of the temperature-sensitive non-contact part 153 in the circumferential direction of the fixing belt 102 is determined so that the activation time of the fixing belt 102 falls within an allowable range (for example, within three seconds).

The mount part 154 is arranged such that a segment CD extends along the X direction. Also, as shown in FIG. 7, the mount part 154 has through holes (not shown) penetrating through part of the mount part 154 in the Y direction, and are mounted to the protruding portions 129B of the coupling member 129 together with the extending portions 128A of the leaf springs 128.

As described above, the temperature-sensitive magnetic member 150 is supported by the support body 122 through the leaf springs 127 and 128, and is deformable in the X direction when the extending portions 127A and 128A of the leaf springs 127 and 128 are deformed by bending. The temperature-sensitive magnetic member 150 elastically follows a displacement in the X direction of the fixing belt 102 when the pressure roller 104 (see FIG. 3A) comes into contact with the fixing belt 102.

Operation

Next, operation of the first exemplary embodiment is described.

As shown in FIG. 1, the recording paper P with the toner image transferred thereon through the image formation process of the image forming apparatus 10 is sent to the fixing device 100. Then, as shown in FIG. 3A, in the fixing device 100, the drive motor (not shown) is driven and hence the fixing belt 102 is rotated in the direction indicated by arrow D. At this time, as shown in FIG. 4, the energizing circuit 134 is driven in response to the electric signal from the control circuit 132, and alternating current is supplied to the exciting coil 110.

Figure 11B:
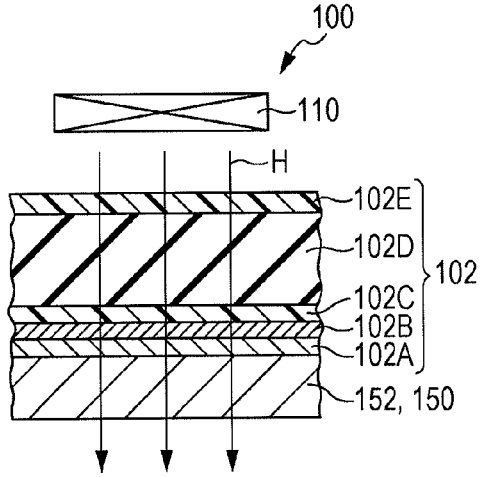
Figure 11C:
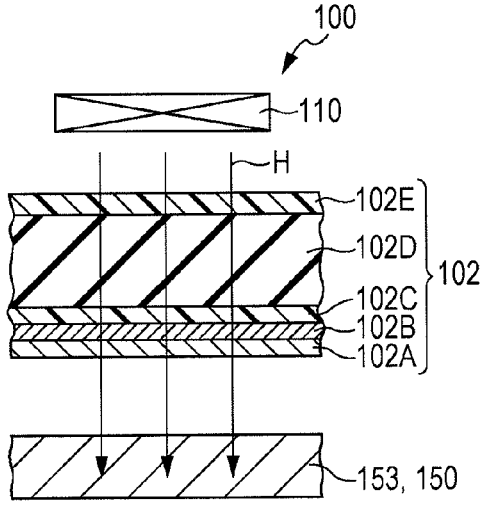
FIGS. 11C and 11D are schematic illustrations respectively showing a state in which a magnetic field acts on the temperature-sensitive magnetic member and a state in which a magnetic field penetrates through the temperature-sensitive magnetic member at a temperature-sensitive non-contact part according to the first exemplary embodiment of the present invention.

Then, as shown in FIGS. 11A and 11C, when the alternating current is supplied to the exciting coil 110, the generation and non-generation of the magnetic field H as the magnetic circuit are repeated around the exciting coil 110. A magnetic path of the magnetic field H generated from the exciting coil 110 becomes a closed magnetic path formed such that the rotating fixing belt 102 and the exciting coil 110 are arranged between the magnetic core 112 (see FIG. 3A) and the temperature-sensitive magnetic member 150. When the magnetic field H passes across the heat-generating layer 102B of the fixing belt 102, eddy current is generated at the heat-generating layer 102B so as to generate a magnetic field that disturbs a change in magnetic field H.

The heat-generating layer 102B generates heat in proportion to the magnitude of skin resistance of the heat-generating layer 102B and the magnitude of eddy current flowing through the heat-generating layer 102B. The generated heat is applied to the fixing belt 102. The temperature of the fixing belt 102 is detected by the thermistor 130 (see FIG. 3A), and if the temperature of the fixing belt 102 does not reach the heat setting temperature (for example, 170° C.), the control circuit 132 controls driving of the energizing circuit 134 to apply alternating current with a predetermined frequency to the exciting coil 110 as shown in FIG. 4. In contrast, if the temperature of the fixing belt 102 reaches the heat setting temperature, the control circuit 132 stops the energization by the energizing circuit 134.

Then, as shown in FIG. 3A, when the temperature of the fixing belt 102 becomes the heat setting temperature or higher, the retract mechanism (not shown) is activated to cause the pressure roller 104 to contact the fixing belt 102. The pressure roller 104 is rotated in the direction indicated by arrow E by the rotating fixing belt 102.

Then, the recording paper P sent to the fixing device 100 is heated and pressed by the fixing belt 102 at the heat setting temperature and the pressure roller 104. Thus, the toner image is fixed to the surface of the recording paper P. As shown in FIG. 1, the recording paper P output from the fixing device 100 is output to the lower tray 52 or the upper tray 56.

Next, operation of the temperature-sensitive contact part 152 and the temperature-sensitive non-contact part 153 is described.

As shown in FIG. 11A, if the temperature of the temperature-sensitive contact part 152 is lower than the permeability-change start temperature in an area where the temperature-sensitive contact part 152 contacts the fixing belt 102, since the temperature-sensitive contact part 152 is a ferromagnetic material, the magnetic field H penetrating through the fixing belt 102 enters the temperature-sensitive contact part 152, forms the closed magnetic path, and enhances the magnetic field H. Accordingly, the amount of heat generated by the heat-generating layer 102B of the fixing belt 102 increases, and the temperature of the fixing belt 102 rises to the heat setting temperature.

As shown in FIG. 11B, if the temperature of the temperature-sensitive contact part 152 is the permeability-change start temperature or higher in the area where the temperature-sensitive contact part 152 contacts the fixing belt 102, since the permeability decreases, the magnetic field H penetrating through the fixing belt 102 also penetrates through the temperature-sensitive contact part 152. Accordingly, the closed magnetic path is no longer formed, magnetic flux density decreases, and the magnetic field H becomes weak. Thus, the amount of heat generated by the heat-generating layer 102B decreases. The degree of temperature rise of the fixing belt 102 decreases.

Since the temperature-sensitive contact part 152 contacts the fixing belt 102, the heat is partly removed by the fixing belt 102. Owing to this, the temperature of the temperature-sensitive contact part 152 itself is prevented from rising to the permeability-change start temperature, and hence the closed magnetic path is continuously formed between the temperature-sensitive contact part 152 and the exciting coil 110. Accordingly, the temperature of the fixing belt 102 is prevented from decreasing when a toner image is continuously fixed to recording paper P. Then, the number of recording paper P available for continuous fixing increases. Also, since the temperature-sensitive contact part 152 is urged by the spring 144 toward the fixing belt 102, the contact state of the temperature-sensitive contact part 152 and the fixing belt 102 is maintained.

Meanwhile, as shown in FIG. 11C, if the temperature of the temperature-sensitive non-contact part 153 is lower than a permeability-change start temperature in an area where the temperature-sensitive non-contact part 153 faces the fixing belt 102 in a non-contact manner, since the temperature-sensitive non-contact part 153 is a ferromagnetic material, the magnetic field H penetrating through the fixing belt 102 enters the temperature-sensitive non-contact part 153, forms a closed magnetic path, and enhances the magnetic field H. Accordingly, the amount of heat generated by the heat-generating layer 102B of the fixing belt 102 increases. Also, regarding the temperature rise of the fixing belt 102, the amount of heat generated by the temperature-sensitive contact part 152 (see FIG. 11A) is larger than the amount of heat generated by the temperature-sensitive non-contact part 153.

Figure 11D:
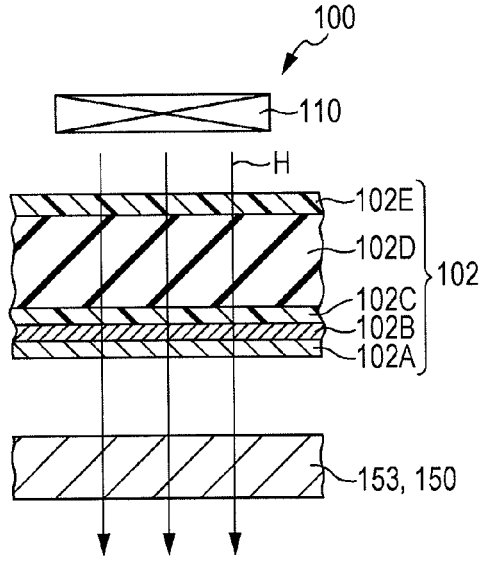

As shown in FIG. 11D, if the temperature of the temperature-sensitive non-contact part 153 is the permeability-change start temperature or higher in the area where the temperature-sensitive non-contact part 153 faces the fixing belt 102 in a non-contact manner, since the permeability decreases, the magnetic field H penetrating through the fixing belt 102 also penetrates through the temperature-sensitive non-contact part 153. Accordingly, the closed magnetic path is no longer formed, magnetic flux density decreases, and the magnetic field H becomes weak. Thus, the amount of heat generated by the heat-generating layer 102B decreases. The degree of temperature rise of the fixing belt 102 decreases.

The temperature-sensitive non-contact part 153 forms the closed magnetic path between the temperature-sensitive non-contact part 153 and the exciting coil 110 and hence causes the temperature of the fixing belt 102 to rise until the temperature becomes the permeability-change start temperature. Also, since the temperature-sensitive non-contact part 153 is in a non-contact state with respect to the fixing belt 102, the temperature-sensitive non-contact part 153 does not remove heat from the fixing belt 102. Accordingly, when the fixing device 100 (see FIG. 3A) is activated, the activation time until the temperature reaches the heat setting temperature is shortened. For example, the activation time is within three seconds (an allowable range).

As described above, the temperature-sensitive magnetic member 150 restricts the activation time within the allowable range by the operation of the temperature-sensitive non-contact part 153, and restricts a decrease in temperature of the fixing belt 102 during continuous fixing by the operation of the temperature-sensitive contact part 152.

Figure 12A:
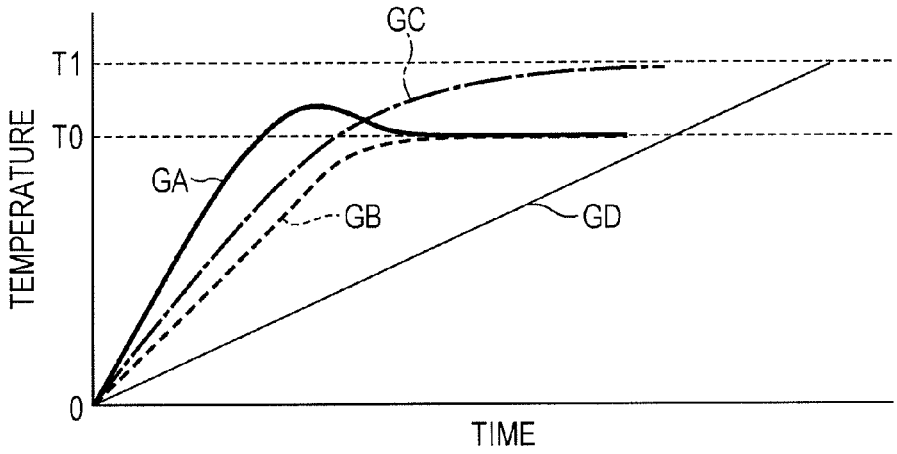
FIG. 12A is a graph showing the relationship between the time and the temperature of the temperature-sensitive contact part and the temperature-sensitive non-contact part according to the first exemplary embodiment of the present invention.

FIG. 12A is a graph schematically showing the relationship between the time and the temperature of each part in the fixing device 100. In the following description for graphs, the respective members of the fixing device 100 are described with reference to FIGS. 3A and 9, and the description of the figure numbers is omitted.

In FIG. 12A, a graph GA (a thick solid line) indicates the temperature of the fixing belt 102, and a graph GB (a thick broken line) indicates the temperature of the temperature-sensitive contact part 152. Also, a graph GC (a dotted-chain line) indicates the temperature of the temperature-sensitive non-contact part 153, and a graph GD (a thin solid line) indicates the temperature of the temperature-sensitive non-contact part 153 if it is assumed that the temperature-sensitive magnetic member 150 is entirely formed of the temperature-sensitive non-contact part 153. Further, a temperature T0 is the heat setting temperature, and a temperature T1 is the Curie temperature at which a ferromagnetic material is changed to a paramagnetic material.

As shown in the graph GA, the temperature of the fixing belt 102 temporarily becomes higher than the heat setting temperature T0 because of heat generation by electromagnetic induction effect of the magnetic field H generated by application of electricity to the exciting coil 110 during activation, and then application and non-application of electricity are repeated to maintain the temperature at the heat setting temperature T0.

As shown in the graph GB, since the temperature-sensitive contact part 152 contacts the fixing belt 102, the temperature of the temperature-sensitive contact part 152 rises as the temperature of the fixing belt 102 rises, and becomes a temperature close to the temperature of the fixing belt 102. The temperature-sensitive contact part 152 gradually generates heat (self-heating); however, the heat is removed by the fixing belt 102. Hence, a temperature rise due to the self-heating is restricted.

As shown in the graph GC, since the heat of the fixing belt 102 is hardly removed because of heat insulation effect of the air present in a gap between the temperature-sensitive non-contact part 153 and the fixing belt 102, the temperature of the temperature-sensitive non-contact part 153 gradually rises due to self-heating, and becomes higher than the temperature of the temperature-sensitive contact part 152. Since the temperature-sensitive non-contact part 153 is integrally formed with the temperature-sensitive contact part 152, heat is partly transferred to the temperature-sensitive contact part 152. Accordingly, the temperature of the temperature-sensitive non-contact part 153 is changed in a smooth curve form, and is prevented from reaching the permeability-change start temperature (see FIG. 12A) and the Curie temperature T1 in a short time.

If the temperature-sensitive magnetic member 150 is entirely formed of the temperature-sensitive non-contact part 153, as shown in the graph GD, the temperature of the temperature-sensitive magnetic member 150 rises in a linear form, and reaches the permeability-change start temperature (see FIG. 12A) and the Curie temperature T1 in a short time.

Figure 12B:
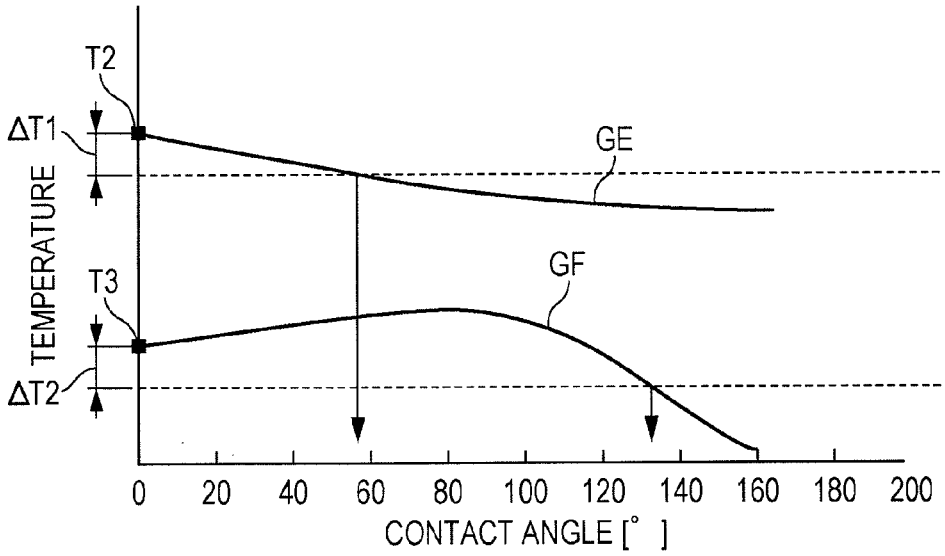
FIG. 12B is a graph showing the temperature of the temperature-sensitive magnetic member when a toner image is fixed to large-size recording paper and the temperature of part of the fixing belt not facing paper when a toner image is fixed to small-size recording paper in the fixing device according to the first exemplary embodiment of the present invention, the graphs showing a state in which the angle of a contact part of the temperature-sensitive magnetic member is changed.

FIG. 12B illustrates graphs GE and GF. The graph GE indicates the temperature of part of the fixing belt 102 not facing paper when a toner image is fixed to recording paper P with a small size in the width direction. The graph GF indicates the temperature of the temperature-sensitive contact part 152 when a toner image is fixed to recording paper P with a large size in the width direction orthogonal to the transport direction. The graphs GE and GF are plotted through measurement by changing a contact angle (corresponding to the central angle θ1 in FIG. 9) of the temperature-sensitive contact part 152. The graph GE indicates the temperature of the part of the fixing belt 102 not facing paper, and the graph GF indicates the temperature of the temperature-sensitive contact part 152.

As shown in the graph GE, if the contact angle between the temperature-sensitive contact part 152 and the fixing belt 102 increases, the temperature of the part of the fixing belt 102 not facing paper during fixing to small size paper decreases from a temperature T2. It is known that, if a temperature decrease ΔT1 from the temperature T2 becomes 5° C. or larger, an excessive temperature rise of the part of the fixing belt 102 not facing paper is restricted (temperature restriction effect is provided). Accordingly, the contact angle of the temperature-sensitive contact part 152 is desirably 60° or larger.

As shown in the graph GF, if the contact angle between the temperature-sensitive contact part 152 and the fixing belt 102 increases, the temperature of the part of the fixing belt 102 not facing paper during fixing to large size paper temporarily rises from a temperature T3 and then decreases. It is known that, if a temperature decrease ΔT2 from the temperature T3 becomes 5° C. or larger, an excessive temperature rise of the temperature-sensitive contact part 152 is restricted (temperature restriction effect is provided). Accordingly, the contact angle of the temperature-sensitive contact part 152 is desirably 130° or larger.

As described above, the contact angle between the temperature-sensitive contact part 152 and the fixing belt 102 is desirably 60° or larger and more desirably 130° or larger. For example, if the temperature-sensitive contact part 152 and the temperature-sensitive non-contact part 153 are used within the entire angle range of 180°, when the contact angle of the temperature-sensitive contact part 152 is θx, the angle (central angle) of the temperature-sensitive non-contact part 153 is obtained by 180°−θx.

Second Exemplary Embodiment

Next, examples of a fixing device and an image forming apparatus according to a second exemplary embodiment of the present invention are described. It is to be noted that reference signs which are the same as those of the first exemplary embodiment are applied to members which are basically the same as those of the first exemplary embodiment, and the description is omitted.

Figure 13A:
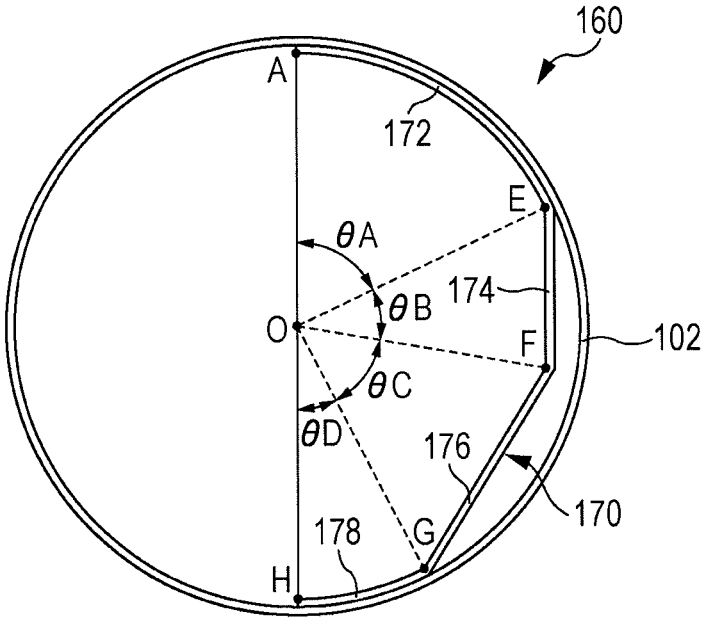
FIG. 13A is a cross-sectional view of a temperature-sensitive magnetic member according to a second exemplary embodiment of the present invention.

FIG. 13A illustrates the fixing belt 102 and a temperature-sensitive magnetic member 170 included in a fixing device 160 according to the second exemplary embodiment. The fixing device 160 includes the temperature-sensitive magnetic member 170 instead of the temperature-sensitive magnetic member 150 of the fixing device 100 (see FIG. 3A), and the other configuration of the fixing device 160 is similar to that of the fixing device 100.

The temperature-sensitive magnetic member 170 is formed of a material having a characteristic in which its permeability starts continuously decreasing from a permeability-change start temperature in a temperature range that is the heat setting temperature of the fixing belt 102 or higher and the heat-resistance temperature of the fixing belt 102 or lower. For example, a Fe—Ni alloy is used.

Also, when viewed in an X-Y section, the temperature-sensitive magnetic member 170 includes an arc-like first temperature-sensitive contact part 172, a linear first temperature-sensitive non-contact part 174, a linear second temperature-sensitive non-contact part 176, and an arc-like second temperature-sensitive contact part 178, the parts which are integrally formed with each other. In FIG. 13A, it is assumed that an intersection point of the line L passing through the perfect circle reference center O of the fixing belt 102 and one end of the first temperature-sensitive contact part 172 is a point A, a boundary point of the first temperature-sensitive contact part 172 and the first temperature-sensitive non-contact part 174 is a point E, and a boundary point of the first temperature-sensitive non-contact part 174 and the second temperature-sensitive non-contact part 176 is a point F. Further, it is assumed that a boundary point of the second temperature-sensitive non-contact part 176 and the second temperature-sensitive contact part 178 is a point G, and an end point of the second temperature-sensitive contact part 178 opposite to the point G is a point H.

For example, the first temperature-sensitive contact part 172 is formed in an arc-like shape with a central angle AOE (an angle θA) being an acute angle, and is entirely in contact with the inner side of the fixing belt 102 along the exciting coil 110 (see FIG. 3A). An outer peripheral surface of the first temperature-sensitive contact part 172 is treated with surface processing (for example, nitriding). The first temperature-sensitive contact part 172 is also substantially entirely in contact with the inner side of the fixing belt 102 in the Z direction. For example, in the second exemplary embodiment, θA=65°.

The first temperature-sensitive non-contact part 174 extends from the other point (the point E) of the first temperature-sensitive contact part 172 to the lower side, and has an angle EOF (an angle θB) being an acute angle. Also, the second temperature-sensitive non-contact part 176 extends from the other point (the point F) of the first temperature-sensitive non-contact part 174 to the obliquely lower side, and has an angle FOG (an angle θC) being an acute angle. The first temperature-sensitive non-contact part 174 and the second temperature-sensitive non-contact part 176 are spaced from the fixing belt 102, and hence arranged in a non-contact manner with respect to the fixing belt 102. The widths of the first temperature-sensitive non-contact part 174 and the second temperature-sensitive non-contact part 176 in the circumferential direction of the fixing belt 102 are determined so that the activation time of the fixing belt 102 falls within an allowable range (for example, within three seconds). For example, in the second exemplary embodiment, θB+θC=87°.

For example, the second temperature-sensitive contact part 178 is formed in an arc-like shape with a central angle GOH (an angle θD) being an acute angle, and is entirely in contact with the inner side of the fixing belt 102 along the exciting coil 110 (see FIG. 3A). An outer peripheral surface of the second temperature-sensitive contact part 178 is treated with surface processing (for example, nitriding). The second temperature-sensitive contact part 178 is also substantially entirely in contact with the inner side of the fixing belt 102 in the Z direction. For example, in the second exemplary embodiment, θD=28°.

As described above, the temperature-sensitive magnetic member 170 is configured such that the first temperature-sensitive contact part 172 and the second temperature-sensitive contact part 178 are provided along the circumferential direction of the fixing belt 102. Also, the first temperature-sensitive contact part 172 and the second temperature-sensitive contact part 178 are connected with both sides of the first temperature-sensitive non-contact part 174 and the second temperature-sensitive non-contact part 176 in the circumferential direction of the fixing belt 102.

Operation

Next, operation of the second exemplary embodiment is described.

Since the first temperature-sensitive contact part 172 and the second temperature-sensitive contact part 178 contact the fixing belt 102, the heat is partly removed by the fixing belt 102. Owing to this, the temperatures of the first and second temperature-sensitive contact parts 172 and 178 themselves are prevented from rising to the permeability-change start temperature, and hence closed magnetic paths are continuously formed between the first and second temperature-sensitive contact parts 172 and 178 and the exciting coil 110. Accordingly, the temperature of the fixing belt 102 is prevented from decreasing when a toner image is continuously fixed to recording paper P. Then, the number of recording paper P available for continuous fixing increases. Also, since the first and second temperature-sensitive contact parts 172 and 178 are urged by the spring 144 toward the fixing belt 102, the contact state between the fixing belt 102 and the first and second temperature-sensitive contact parts 172 and 178 is maintained.

The first and second temperature-sensitive non-contact parts 174 and 176 form the closed magnetic paths between the first and second temperature-sensitive non-contact part 174 and 176 and the exciting coil 110 and hence cause the temperature of the fixing belt 102 to rise until the temperatures become the permeability-change start temperatures. Also, since the first and second temperature-sensitive non-contact parts 174 and 176 are in a non-contact state with respect to the fixing belt 102, the first and second temperature-sensitive non-contact parts 174 and 176 do not remove heat from the fixing belt 102. Accordingly, when the fixing device 100 (see FIG. 3A) is activated, the activation time until the temperature reaches the heat setting temperature is shortened. For example, the activation time is within three seconds (an allowable range).

Also, the temperature-sensitive magnetic member 170 includes the first and second temperature-sensitive contact parts 172 and 178 that contact the fixing belt 102 and are provided at two positions spaced from each other in the circumferential direction of the fixing belt 102. Accordingly, when the fixing belt 102 is rotated, the fixing belt 102 is supported from the inner side at plural positions (in this exemplary embodiment, two positions) in the circumferential direction, and hence the fixing belt 102 is prevented from being eccentric during rotation.

Further, the temperature-sensitive magnetic member 170 is configured such that the first temperature-sensitive contact part 172 and the second temperature-sensitive contact part 178 are connected with both sides of the first temperature-sensitive non-contact part 174 and the second temperature-sensitive non-contact part 176 in the circumferential direction of the fixing belt 102. Accordingly, if the first and second temperature-sensitive non-contact parts 174 and 176 generate heat, the generated heat is transferred to the first and second temperature-sensitive contact parts 172 and 178 connected at both ends, and is transferred to and consumed by the fixing belt 102. Accordingly, even if the heat insulating effect by the air is present in the gap between the fixing belt 102 and the first and second temperature-sensitive non-contact parts 174 and 176, temperature rises of the first and second temperature-sensitive non-contact parts 174 and 176 are restricted.

In addition, in the temperature-sensitive magnetic member 170, the temperature-sensitive non-contact part is divided into the first temperature-sensitive non-contact part 174 and the second temperature-sensitive non-contact part 176. Accordingly, as compared with a case having a single temperature-sensitive non-contact part, the difference between a maximum value and a minimum value of the gap between the temperature-sensitive non-contact part and the fixing belt 102 in the circumferential direction of the fixing belt 102 decreases, and a temperature difference (temperature unevenness) is prevented from being generated in the circumferential direction of the fixing belt 102.

The present invention is not limited to the above-described exemplary embodiments.

The temperature-sensitive magnetic member 150, 170 may have a slit in a direction intersecting with a direction in which eddy current flows, to prevent a temperature rise due to self-heating.

Figure 13B:
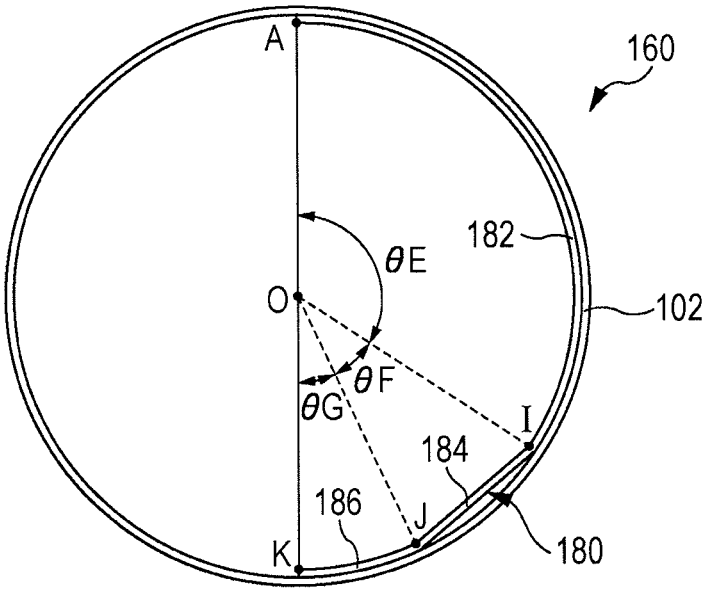
FIG. 13B is a cross-sectional view of a modification of the temperature-sensitive magnetic member according to the second exemplary embodiment of the present invention.

Also, as shown in FIG. 13B, a temperature-sensitive magnetic member 180 including a single temperature-sensitive non-contact part may be provided in the fixing device 160 instead of the temperature-sensitive magnetic member 170. The temperature-sensitive magnetic member 180 includes an arc-like first temperature-sensitive contact part 182, a linear temperature-sensitive non-contact part 184 extending from one end of the temperature-sensitive contact part 182 to the obliquely lower side, and an arc-like second temperature-sensitive contact part 186 connected with one end of the temperature-sensitive non-contact part 184.

It is assumed that an intersection point of the line L passing through the perfect circle reference center O of the fixing belt 102 and one end of the first temperature-sensitive contact part 182 is a point A, a boundary point of the first temperature-sensitive contact part 182 and the temperature-sensitive non-contact part 184 is a point I, and a boundary point of the temperature-sensitive non-contact part 184 and the second temperature-sensitive contact part 186 is a point J. Further, an end point of the second temperature-sensitive contact part 186 opposite to the point J is a point K.

For example, the first temperature-sensitive contact part 182 is formed in an arc-like shape with a central angle AOI (an angle θE) being an obtuse angle, and is entirely in contact with the inner side of the fixing belt 102 along the exciting coil 110 (see FIG. 3A). Also, the temperature-sensitive non-contact part 184 has an angle IOJ (an angle θF) being an acute angle, and is arranged in a non-contact state with a gap with respect to the fixing belt 102. For example, the second temperature-sensitive contact part 186 is formed in an arc-like shape with a central angle JOK (an angle θG) being an acute angle, and is entirely in contact with the inner side of the fixing belt 102 along the exciting coil 110 (see FIG. 3A). For example, θE=122°, θF=30°, and θG=28°.

As described above, a temperature-sensitive magnetic member including a single temperature-sensitive non-contact part and temperature-sensitive contact parts provided at both sides of the temperature-sensitive non-contact part may be used. Also, the total angle (central angles+angles) indicative of the installation range of the temperature-sensitive contact part(s) and the temperature-sensitive non-contact part(s) is not limited to 180°, and may be smaller or larger than 180°. Further, the temperature-sensitive contact parts and the temperature-sensitive non-contact parts may be each provided at plural positions that are three or more positions in the circumferential direction of the fixing belt 102.

In addition, if the effect of a temperature rise due to self-heating of the temperature-sensitive non-contact part(s) is small, the temperature-sensitive contact part(s) and the temperature-sensitive non-contact part(s) may be arranged separately from each other (divided) in the circumferential direction of the fixing belt 102.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a magnetic-field generating unit that generates a magnetic field;

a substantially cylindrical fixing rotational body that is arranged to face the magnetic-field generating unit, generates heat by electromagnetic induction of the magnetic field, melts a developer image, and fixes the developer image to a recording medium;

a temperature-sensitive contact part that contacts an inner side of the fixing rotational body, and is arranged to face the magnetic-field generating unit, a permeability of the temperature-sensitive contact part decreasing if a temperature of the temperature-sensitive contact part becomes a permeability-change start temperature or higher; and a temperature-sensitive non-contact part that is arranged at the inner side of the fixing rotational body to face the magnetic-field generating unit in a range different from a range of the temperature-sensitive contact part, and is spaced from the fixing rotational body, a permeability of the temperature-sensitive non-contact part decreasing if a temperature of the temperature-sensitive non-contact part becomes a permeability-change start temperature or higher, wherein an angle defined by the temperature-sensitive contact part and the center of the fixing rotational body is 60° or larger, wherein the temperature-sensitive contact part includes a plurality temperature-sensitive contact portions, and wherein the temperature-sensitive non-contact part is disposed between two of the lurality of temperature-sensitive contact portions.

2. The fixing device according to claim 1, further comprising an urging portion that urges the temperature-sensitive contact part toward the fixing rotational body so that the contact state between the temperature-sensitive contact part and the fixing rotational body is maintained.

3. The fixing device according to claim 1, wherein the plurality of temperature-sensitive contact portions are provided at a plurality of positions along a circumferential direction of the fixing rotational body.

4. The fixing device according to claim 3, wherein both sides of the temperature-sensitive non-contact part are connected to the plurality of temperature-sensitive contact portions in the circumferential direction.

5. An image forming apparatus comprising:

a developer image forming unit that forms a developer image on a recording medium; and the fixing device according to claim 1 that fixes the developer image formed by the developer image forming unit to the recording medium.

* * * * *